United States Patent [19]

Kearns

[11] Patent Number: 4,659,546

[45] Date of Patent: Apr. 21, 1987

[54] FORMATION OF POROUS BODIES

[75] Inventor: Michael W. Kearns, Dudley, England

[73] Assignee: IMI Titanium Limited, Birmingham, England

[21] Appl. No.: 813,467

[22] Filed: Dec. 24, 1985

[30] Foreign Application Priority Data

Jan. 26, 1985 [GB] United Kingdom ..... 8502021

[51] Int. Cl.[4] ..... B22F 3/16

[52] U.S. Cl. ..... 419/2; 419/23; 419/38; 419/49; 419/53; 419/57; 264/50; 264/51; 75/245

[58] Field of Search ..... 419/2, 38, 49, 57, 53, 419/23; 75/245; 264/50, 51

[56] References Cited

U.S. PATENT DOCUMENTS

| | | | |
|---|---|---|---|
| 3,328,139 | 6/1967 | Hodge et al. | 419/2 X |
| 3,893,852 | 7/1975 | Bergman et al. | 419/49 |
| 4,059,442 | 11/1977 | Bernard | 419/2 |
| 4,359,336 | 11/1982 | Bowles | 419/49 |

*Primary Examiner*—Stephen J. Lechert, Jr.
*Assistant Examiner*—Susan Wolffe
*Attorney, Agent, or Firm*—Cushman, Darby & Cushman

[57] ABSTRACT

A method of manufacturing a porous body using particulate material as a starting stock. The particles are inserted in a can, the can evacuated and inert gas admitted to a predetermined back-fill pressure. After hot isostatic pressing, the compact so formed is cooled and subsequently heat treated to permit the pores formed in pressing to expand and form a porous body.

10 Claims, No Drawings

FORMATION OF POROUS BODIES

BACKGROUND OF THE INVENTION

This invention relates to the formation of porous bodies and in particular to a method of manufacturing such bodies from particulate material. By porous, we mean a body having interstices or pores of unspecified size and occupied by gaseous matter, said interstices or pores being surrounded by solid constituents of the body. The method is particularly suitable for the manufacture of metallic porous bodies, but is not restricted to such.

SUMMARY OF THE INVENTION

According to one aspect of the invention, a method of manufacturing a porous body includes the stages of placing a quantity of particulate material in a gas-tight container, evacuating said container, admitting to said container a gas, compacting said particulate material to form a compact within said container under a pressure which results in the particulate material being bonded together around discrete gas-containing pores and also reduces the volume of the initially formed pores within said compact so that the gas in said pores is at a higher pressure than that in the initially formed pores, and heat treating said compact at a temperature within a range which permits the pressure within said pores to exceed the material flow stress and thereby expand to provide a porous body.

The particulate material may be a metal or a metal alloy, a cermet, a plastics substance or a ceramic substance or any other material which can exist in particulate form and be compacted so as to bond the particulate material together. The material will also require to be capable of undergoing plastic deformation so that it has a determinable flow stress. Flow stress is determinable for materials which are capable of plastic deformation above the yield of the material. The particulate material may be pre-compressed to some degree before it is placed in the container, as long as the gas can penetrate into its interior.

The method may be particularly suitable for the production of porous bodies of metals or their alloys.

The compaction may be carried out under isostatic conditions and at above ambient temperatures (so-called hot isostatic pressing), but for suitable materials the invention may include compaction at ambient temperatures. The temperature must however be sufficiently high for partial consolidation of the material to occur. Following compaction, the compact may be cooled, typically to ambient temperature, but a pressure is preferably maintained at least until a temperature is reached below which the material will not yield.

The gas is preferably an inert gas such as argon or helium, but other gases which are reactive may be employed in circumstances where it is desired to combine the compaction with chemical processing.

The particulate material may include powders or granules or possibly larger particles. The particulate material may be of spherical or regular or irregular shape, and the particulate material placed into the gas-tight container may comprise particles of different sizes and shapes or particles of similar size and/or shape.

The evacuation or degassing of the contents of the container may be carried out at both ambient temperature and/or at an elevated temperature. Hot degassing may follow degassing at ambient temperature. When degassing is carried out at an elevated temperature, the container and its contents may be permitted to cool for a predetermined period before gas is introduced into the container.

The gas is preferably admitted to the container under a pressure (called the back-fill pressure) sufficient to enable a particular porosity to be achieved. For a particular material the gas may be admitted under an increased pressure if increased porosity in the finally formed body is required. Similarly, the pressure employed in compaction will vary with the percentage porosity required in the final body, a higher pressure being required for increased porosity for any given particular material, given back-fill pressure for one gas and given heat treatment process.

Typical back-fill pressures employed (all in absolute atmospheres) may be 0.1 atm, 0.2 atm, 0.5 atm, 1.0 atm, 2.0 atm, 3.0 atm or 5.0 atm. Following the compaction step the pressure within the pores may be increased to as much as 100, 1000 or 2000 atm or even greater. The greater the pressure developed within the pore, the greater the amount of expansion of the pore on heat treatment. The pores could in fact become the majority phase in the porous body, and might occupy as much as 90% or more of the volume of the body. Typical hot isostatic compaction pressures are substantially equal to the pore pressure. Typical temperatures for the compaction of e.g. commercial purity titanium would be around 850° C. and for Ti-6Al-4V around 930° C.

The heat treatment may take place in the absence of any externally applied pressure other than atmospheric. In certain applications however the compact may be heat treated within an enclosure or cavity, such that on heating, the pore pressure causes the compact to expand into engagement with one or more walls of the enclosure or cavity. Heat treatment may be carried out with the compact at below atmospheric pressure, the body being permitted to cool prior to its subequently being exposed to ambient pressure.

A skin or external layer of material identical to or different from the compact may be bonded to the compact prior to heat treatment, such that said skin or layer is caused to expand during said heat treatment under the pressure arising from the expansion of the compact. The skin may be formed by the container in which the particulate material is subjected to compaction.

The compact may be mechanically worked after compaction but prior to heat treatment to change the shape of the originally formed pores e.g. to elongate them, such that on heat treatment greater expansion takes place in one dimension than in the others. Such elongation could be achieved e.g. by hot rolling or extrusion.

The heat treatment period may be varied to give varying degrees of porosity for identical materials having previously received identical treatment e.g. identical back-fill pressure of the same inert gas and identical isostatic pressing.

The pores of the compact are such as to not interconnect with one another, although upon heat treatment some of the pores may expand to merge with one another so that the porous body may have pores of varying size within it. With porosity levels of the order of 50% say, such pores occupy half the volume of the body, and it may be that some of the pores have merged to provide cavities of a substantial size.

DESCRIPTION OF THE PREFERRED EMBODIMENT

One embodiment of the invention will now be described, by way of example only.

EXAMPLE 1

Powder, consisting essentially of spherically shaped particles of the alloy Ti-6Al-4V was introduced into a thin-walled metal container using a vibratory table to reduce voids. Residual gas was then extracted from the container by pumping down to less than $10^{-5}$ torr at ambient temperature. This was followed by hot degassing at 800° C. for about 8 hours, the vacuum being maintained less than $10^{-5}$ torr and the container and its contents were then permitted to cool for about half a day.

High purity argon gas was then introduced into the container until the back-fill pressure reached 0.5 atm. The container was then sealed and subjected to hot isostatic pressing at a temperature of 950° C. and a pressure of 1 000 atm for about 4 hours. After subsequent cooling to room-temperature with the pressure maintained the porosity of the compact was approximately 0.1% ie the compact had 99.9% theoretical density.

The compact was subsequently heat treated in a vacuum and after a heat treatment cycle of 65 hours at 1240° C. the porosity, measured at room temperature, had increased to approximately 26%. An examination of the macro/microstructure of this porous body showed a high density of pores, the pores generally remaining discrete ie non-inter-connecting.

EXAMPLE 2

Powder of the same alloy as in Example 1 with a mean particle size of 250 microns was subjected to an argon back-fill pressure of 5.0 atm. The subsequently produced compact received a heat treatment of 16 hours at 1 100° C. and resulted in a porosity of 30%. All the other parameters were identical with Example 1. Heat treatments at 930° C. at 1 300° C. for 16 hours gave porosity levels of 23% and 24% respectively.

EXAMPLE 3

Powder of the same alloy as in Example 1 with a distributed particle size up to 500 microns were subjected to the same argon back-fill pressure and heat treatment cycles as in Example 2. The resulting porosity levels were 930° C.: 17%, 1 100° C.: 23% and 1 300° C.: 19%.

EXAMPLE 4

Powder of the same alloy as Example 1 was back-filled with argon and compacted under identical conditions to as Example 1. The compact was then hot-rolled into a sheet at 800° C. with an 83% reduction in the rolling direction without any break-up of the material. The rolled compact was then heat-treated in a vacuum at 1 100° C. for 16 hours. The overall porosity of the resultant product was 30%, with the significant expansion of the compact occurring in a direction perpendicular to the rolling direction.

EXAMPLE 5

Powder of the same alloy as Example 1 was back-filled with argon at pressures of 2.0 atm and 5.0 atm, and then subjected to isostatic pressing under the same conditions as Example 1. The two samples were then extruded with a copper coating at a ratio of 16:1 without any break-up of the samples. The pores in both these samples and in the hot rolled material of Example 4 were clearly elongated, but remained substantially discrete.

I claim:

1. A method of manufacturing a porous body including the stages of placing a quantity of particulate material in a container capable of being made gas-tight, evacuating said container, admitting to said container a gas, compacting said particulate material at a temperature above ambient temperature to form a compact within said container under a pressure which results in the particulate material being bonded together around discrete gas-containing pores and also reduces the volume of the initially formed pores within said compact so that the gas in said pores is at a higher pressure than that in the initially formed pores, permitting said compact to cool while maintaining said pressure until a temperature is reached below which the material will not yield, removing said pressure, and subsequently heat treating said compact at a temperature within a range which permits the pressure within said pores to exceed the material flow stress and thereby expand to provide a porous body.

2. A method as claimed in claim 1 wherein the gas is an inert gas.

3. A method as claimed in claim 1 wherein the heat treatment takes place in the absence of any externally applied pressure other than atmospheric pressure.

4. A method as claimed in claim 1 wherein the compact is heat treated within an enclosure or cavity, such that on heating the compact expands into engagement with one or more walls of the enclosure or cavity.

5. A method as claimed in claim 1 wherein the back-fill pressure caused by admitting such gas to said container is between 0.1 and 5.0 absolute atmospheres prior to compaction.

6. A method as claimed in claim 1 wherein a skin or external layer of material is bonded to the compact prior to heat treatment, such that said skin or layer is caused to expand during said heat treatment under the pressure arising from the expansion of the compact.

7. A method as claimed in claim 1 wherein the compact is mechanically worked after compaction but before heat treatment.

8. A method as claimed in claim 1 wherein the material is a metal or metal alloy.

9. A method as claimed in claim 8 in which the material is titanium or a titanium alloy.

10. A method as claimed in claim 9 in which the compaction temperature is between 800° and 1 000° C.

* * * * *